United States Patent [19]

Wood

[11] Patent Number: 4,655,286

[45] Date of Patent: Apr. 7, 1987

[54] METHOD FOR CEMENTING CASING OR LINERS IN AN OIL WELL

[75] Inventor: Edward T. Wood, Kingwood, Tex.

[73] Assignee: CTC Corporation, Houston, Tex.

[21] Appl. No.: 702,588

[22] Filed: Feb. 19, 1985

[51] Int. Cl.[4] ..... E21B 33/16; E21B 33/27; E21B 34/08

[52] U.S. Cl. ..... 166/285; 166/184; 166/185; 166/187; 166/191; 166/289; 166/325; 166/386; 166/387

[58] Field of Search ..... 166/285, 289, 386, 387, 166/127, 184, 185, 187, 191, 325

[56] References Cited

U.S. PATENT DOCUMENTS

| | | | |
|---|---|---|---|
| 2,029,380 | 2/1936 | Manning | 166/289 |
| 2,173,034 | 9/1939 | Armentrout et al. | 166/289 |
| 2,986,217 | 5/1961 | Johnston | 166/285 X |
| 3,055,424 | 9/1962 | Allen | 166/285 |
| 3,062,285 | 11/1962 | Kipp | 166/289 |
| 3,335,795 | 8/1967 | Richard et al. | 166/289 |
| 3,865,188 | 2/1975 | Doggett et al. | 166/285 |
| 4,155,404 | 5/1979 | Hollingsworth | 166/187 X |
| 4,420,159 | 12/1983 | Wood | 166/187 X |
| 4,440,226 | 4/1984 | Suman, Jr. | 166/285 X |
| 4,450,912 | 5/1984 | Callihan et al. | 166/289 |

*Primary Examiner*—George A. Suchfield

[57] ABSTRACT

A method for cementing a casing or a liner traversing earth formations comprising the supplemental injection of cement at a pressure greater than the pore pressure in the earth formations during a cementing operation to enchance the effectiveness of the cement integrity by maintaining hydrostatic pressure in an annulus between the pipe and the borehole at a location where the pore pressure of the earth formations is apt to impair the cement integrity in the annulus thereby preventing annular migration of gas or liquids in the cement seal between the earth formations and a liner or casing.

6 Claims, 7 Drawing Figures

METHOD FOR CEMENTING CASING OR LINERS IN AN OIL WELL

FIELD OF THE INVENTION

This invention relates to methods and apparatus for cementing a liner or a casing in a borehole traversing earth formations, and more particularly, to providing supplemental injection of cement under hydrostatic pressure along the length of a liner or a casing at locations where pore pressure may have an effect on the cement integrity during the cementing operation for increasing the effectiveness of the cement integrity in the annulus.

In the development of an oil well it is customary to first drill a large diameter borehole from the earth's surface for several thousand feet and then cement a so-called surface casing in the drilled borehole by injecting a liquid cement slurry under pressure through the casing and up the annulus between the open borehole and the outer surface of the surface casing while displacing the mud in the casing ahead of the cement. Next, after the cement in the annulus has cured or hardened, a smaller diameter drill bit is utilized to drill through the cement in the surface casing to drill a second and deeper borehole into the earth formations where the second borehole has a smaller diameter than the diameter of the surface borehole.

With respect to the section of borehole next drilled below a surface casing, at an appropriate depth, the drilling of the borehole is discontinued and a string of pipe commonly called a casing or liner is inserted through the surface casing. As a matter of nomenclature, a liner is a string of pipe typically suspended in the lower end of the surface casing by a liner hanger so that the lower end of the liner does not touch the bottom of the borehole and the liner thus is suspended under the tension of the pipe weight on the liner hanger. In some instances, a liner is set on the bottom of the borehole but its upper end does not extend to the earth's surface.

If the pipe set in the borehole next drilled extends to the surface of the earth it is also called a casing. If a casing is disposed within a surface casing or if a liner is used, the string of pipe typically carries with it, a bottom casing shoe and float and landing collars which are utilized in passing cement through the string of pipe to the annulus between the string of pipe and the borehole until the cement column reaches the overlap between the string of pipe and the surface casing or to a desired level. When the cementing operation is completed and the cement sets, there is a column of cement in the annulus and the second string of pipe.

In the U.S. Pat. No. 4,407,365 issued on Oct. 4, 1983 to Claude E. Cooke, Jr., is a detailed explanation of most of the problems and a number of solutions to obtaining total zonal isolation of producing formations by cementing. The Cooke patent describes the problem of "annular fluid flow" observed in wells, particularly deep well completions across relatively high pressure gas formations, caused by lack of zonal isolation by the cement. As the Cook patent points out, theories of the failures include the possibility (1) that annular fluid flow occurs when the cement slurry fails to uniformly displace the drilling fluid from all parts of the annulus, (2) that annular fluid flow occurs due to a reduction in the hydrostatic pressure exorted by the cement column during its initial hydration period, (3) that annular fluid flow occurs due to a reduction in hydrostatic pressure resulting from a separation of the cement slurry into water and discrete particles of cement, which particles then form a cement lattice and prevent the full hydrostatic pressure of the cement slurry from being transmitted down the annulus, and (4) that there is a loss of hydrostatic pressure due to a build-up of gel strength coupled with a simultaneous volume reduction caused by the cement hydration process and by fluid loss to permeable formations.

The present invention relates to maintaining hydrostatic pressure on the cement slurry at the zone of interest to prevent loss of hydrostatic pressure in the cement column below the pore pressure in the formations.

THE PRESENT INVENTION

The present invention involves a system for admitting cement slurry to a cement slurry column between a pipe and a borehole or larger diameter pipe after the cement slurry has been positioned in the annulus to be cemented and before curing of the cement introducing additional cement slurry at a location where pore pressure of the earth formations is a factor and maintaining additional pressure on the cement slurry in the annulus while it cures.

In the present invention a string of pipe is positioned in a borehole traversing earth formations where the string of pipe has a communication passage between the interior of the string of pipe and the exterior of the string of pipe in at least one location intermediate of the length of the string of pipe. The communication passage is located proximate to earth formations having fluid under pressure (sometimes called "pore pressure").

Next, a cement slurry is injected from the earth's surface under pumping pressure through the interior of the string of pipe to move the cement slurry up into the annulus between the string of pipe and the borehole to a desired level in the annulus between the string of pipe and the borehole while maintaining the level of cement slurry in the interior of the string of pipe above the one location.

Next, pressure is maintained on the cement slurry in the string of pipe where the holding pressure is sufficient to apply cement slurry pressure through communication passage and to inject supplemental cement slurry under such pressure into the cement slurry in the annulus at the one location.

Various arrangements can be used to accomplish the desired results including selectively operable valves in the string of pipe for a primary cementing operation or selectively operable valves below, above or between selectively operable inflatable packers.

The above invention will become more apparent when taken in connection with the following description, claims and drawings in which:

DESCRIPTION OF THE INVENTION

In a typical cementing operation for a liner or casing (a string of pipe 11) in an open borehole, a cement slurry is pumped under pressure through the string of pipe to displace the mud in the string of pipe and in the annulus and to fill the annulus between the string of pipe 11 and the borehole 10 with a cement slurry while displacing the mud in the annulus 12 to the surface of the earth. After the cement slurry is positioned in the annulus 12, the pumping pressure is reduced to a holding pressure to maintain the cement slurry in position and the cement is permitted to set or harden. After the cement cures, it forms an annular load supporting column between the string of pipe and the borehole and is intended to bond or seal at the cement/pipe interface and at the cement-/borehole interface and to prevent gas or liquid migration along the interfaces.

The main problems in cementing a string of pipe in a borehole include: (1) cement channeling, i.e., incomplete displacement of mud in the annulus leaving vertical open channels occurring in the column of cement; (2) gas migration from the earth formations occurring into the cement before it cures or sets; (3) inadequate contact of the cement to the surface of the borehole; and (4) vertical movement or migration of gas, water or oil occurring in the cement before the cement sets or cures.

In any event, after injecting a cement slurry and the hardening of the cement, any cement left in the pipe as well as the destructible cementing equipment such as the casing shoe, float collar and landing collars are subsequently reamed or drilled out to complete the well or to project or deepen the borehole below the lower cemented end of the pipe.

Figure 1:
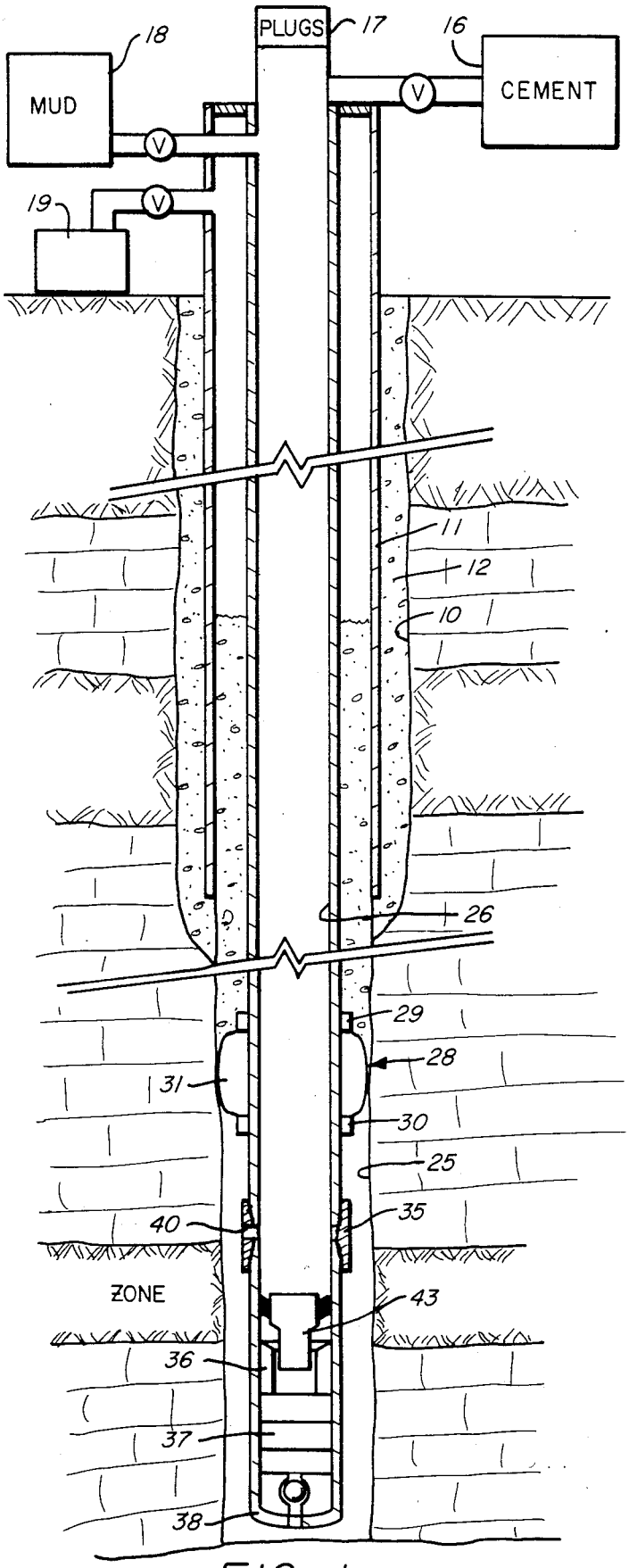
FIG. 1 is a schematic view of a casing cemented in place, with an inflatable packer utilizing the present invention.

Referring now to FIG. 1 and with respect to the present invention, a first, large diameter borehole 10 traversing earth formations is illustrated. A surface casing 11 is cemented in place by a column of cement disposed in the annulus 12 between the borehole 10 and the casing 11. The casing 11 is illustrated as a surface casing which typically is set in place for an interval of two to three thousand feet from the earth's surface or as required by State or Federal regulations.

In cementing the casing 11 in the borehole 10, a cement slurry is pumped through the bore of the casing 11 after the casing 11 is positioned in the borehole 10 by injecting a cement slurry from a source of cement and cementing equipment 16. The flow of cement is controlled by valves. The cement slurry may be preceded, if desired, by a slidable plug (not shown) injected from a plug head 17 into the casing 11 to clearly separate mud in the borehole from the cement slurry and to wipe the pipe. The cement slurry is moved by drilling mud applied under pressure from mud pumping equipment 18 to a slidable plug behind the cement slurry to move the cement slurry. The cement slurry is passed through a cementing shoe (not shown) and float collar (not shown) until the plug latches in a landing collar (not shown). The mud fluid ahead of the cement slurry is recirculated to the mud pit 19 and the back pressure on the mud can be controlled by valves. After the cement has been positioned, it sets up or hardens and the plug, collars and shoe (which are destructible) are drilled out. All of the foregoing is conventional and well known.

Figure 2:
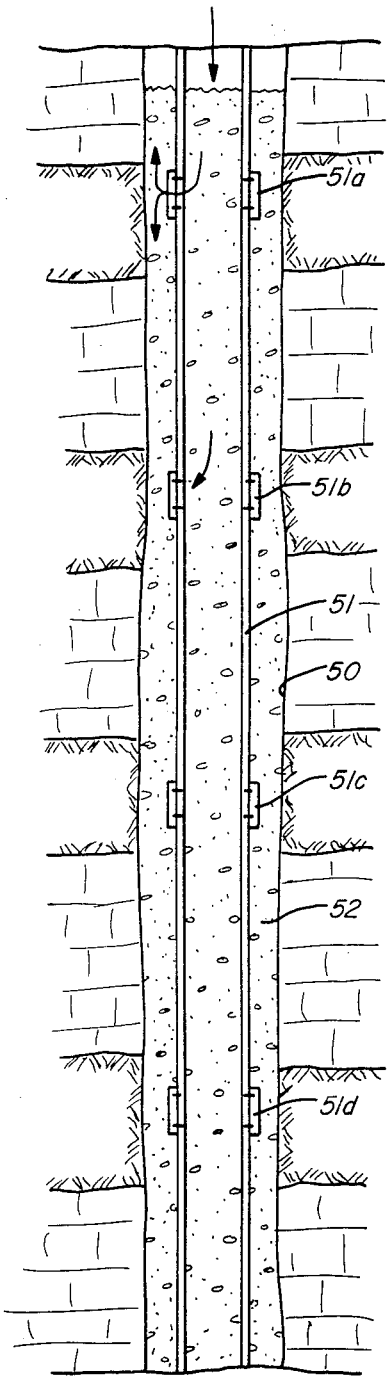
FIG. 2 is a schematic illustration of a cementing operation for a string of pipe utilizing the present invention.

A second smaller diameter borehole 25 is illustrated in FIG. 2 below the borehole 10. The second borehole 25 is drilled after the casing 11 is set in place and cemented by drilling through the casing 11 to the next desired depth of the borehole. As will be appreciated, the weight of the drilling mud is typically increased as a function of various well parameters to provide adequate well control by providing a downhole pressure greater than the pressure in an oil or gas formation.

The borehole 25, when drilled to the desired depth, receives a casing or string of pipe 26 which has an inflatable packer 28 which includes an upper valve collar 29, a lower collar 30 and an elongated, tubular, elastomer sealing element 31 connected to the collars 29, 30. The packer 28 is located typically across the zone to be produced or can be located above or below the zone to be produced.

The inflatable packer 28 is shown in an inflated condition where cement is in the interior of the packing element 31 and compresses the packing element 31 in sealing engagement against the wall of the borehole 25. Prior to cementing, however, the packer 28 is in a deflated condition. When the packing element 31 is inflated it provides a positive seal with respect to the borehole wall and is sealed off with respect to the casing 26 at the collar 30. Details of the functioning and structure of the inflatable packer 28 can be found in U.S. Pat. No. 4,420,159, issued to Edward T. Wood on Dec. 13, 1983, to which reference may be made.

With respect to the present invention it has been determined that when the cement slurry under pressure is pumped into the annulus between the liner or casing and the well bore, the pumping pressure for the circulation of the cement and the surface control of the pressure of the mud above the cement in the annulus typically maintain control over the pressure from fluids in the formation. However, when the cement circulation is stopped, the pressure in the cement column rapidly declines, which can permit gas migration into the cement column and interzonal flow of fluids through the cement column. This loss of pressure in the cement column occurs before the cement cures and before the cement achieves adequate compressive strength. The loss of pressure in the cement also occurs even if surface pressure is applied in the mud in the annulus of the pipe because the gel strength of the cement combined with liquid filtrate loss and shrinkage of the cement during curing of the cement reduces the effect of applied pressure to the cement.

Referring again to FIG. 1, in the present invention a collar 35 is coupled in the string of pipe below the inflatable packer 28 and above a landing collar 36, float collar 37 and cementing shoe 38. The collar 35 has a communication passage 40 which admits cement slurry from the interior of the string of pipe to the exterior of the string of pipe. The location of the collar 35 is proximate to the earth formation zone which has fluid under pressure. The passage 40 may be temporarily closed by a knock-out plug (not shown) or the like.

In the operation of the system, the cementing wiper plug 43 (which precedes the cement slurry injected into the string of pipe) removes the knock-out plug from the valve collar 29 in the inflatable packer 28 and the knock-out plug, if any, in the collar 35. The cement slurry is circulated from the interior of the string of pipe to the annulus between the borehole 25 and the pipe 26 while the packer 28 is deflated and before the valves in the collar 29 are operated. When the cement circulation of the column of cement is above the packer 28 and to a desired depth interval or level, the circulation of cement is stopped and the pressure in the pipe maintained or brought to a value sufficient to open the shear valve in the cementing collar 29 to inflate the packer 28 as shown. Thereafter, the pressure on the cement slurry in the pipe is brought to a value sufficient to permit further injection of cement between the collar 35 and the packer 28 and between the collar 35 and the bottom of the borehole at a pressure greater than the pore pressure of the earth formation zone so that any channels proximate to the collar 35 are filled and pressure is maintained on the cement in the annulus until the cement cures.

Referring now to FIG. 2, a borehole 50 is illustrated as traversing earth formations and a string of pipe which can be either a liner or casing is disposed within the borehole and is to be cemented where the annulus is to be filled with cement. Along the length of the string of pipe at spaced intervals are collars 51*a*, 51*b*, 51*c* and 51*d*. Each of the cementing collars is provided with a shear valve and check valve which provides selective communication between the interior of the pipe and the exterior of the pipe. In the cementing operation, the cement slurry is passed through the interior of the pipe and circulated up through the annulus and past the collars 51*a*–51*d* until the proper level of cement is in location. Thereafter, pressure in the string of pipe is increased to operate the shear valve of the collar 51*d* to inject cement slurry from the interior of the pipe into the cement slurry surrounding the pipe at the location of the collar 51*d*. Thereafter, a further increase in pressure operates the shear valve in the collar 51*c* opening the interior of the pipe to the annulus about the collar 51*c*. Thereafter, a further increase in pressure opens the shear valve in the collar 51*b* opening the interior of the pipe to the annulus of cement slurry about the collar 51*b*. Thereafter, a further increase in pressure opens the shear valve in the collar 51*a* to inject cement slurry from the interior of the pipe into the annulus about the collar 51*a*. By sequentially operating the valves in the collars and applying pressure from the interior of the pipe to the cement slurry in position in the annulus, the injected cement at the collars maintains localized annular pressure in the cement slurry proximate to production zones by replacing any fluid lost via filtrate and cement shrinkage and enhances the gel strength in the cement along the length of the string of pipe. While sequential operation of the valves is believed to be preferable, it is possible to adjust the opening of the valves in the collars in other sequences. The collars are located proximate to porous formations with gas or liquid pressure which is likely to exceed the pressure in the cement column.

Figure 3:
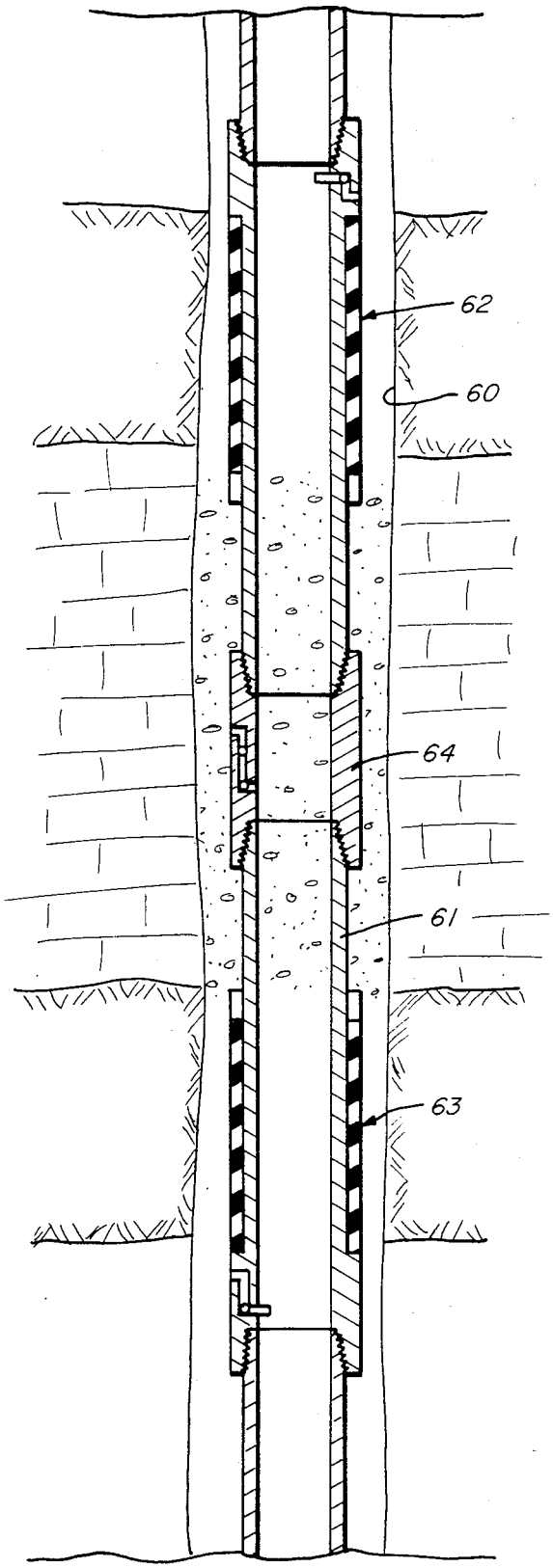
FIG. 3 is a schematic illustration of a typical borehole configuration for cementing a string of pipe in position utilizing the present invention with two inflatable packers.

Referring now to FIG. 3, a borehole 60 is illustrated with a string of pipe 61 where the string of pipe contains upper and lower inflatable packers 62, 63 which straddle a cementing collar 64 located between the inflatable packers 62, 63. In the cementing operation, the cement passes through the bore of the pipe 61 and returns through the annulus between the pipe and the borehole. The valve in the valve collar of the inflatable packer 63 is arranged to operate first so that cement slurry inflates the lowermost packer first and upon a further increase in pressure in the string of pipe, the valve in the valve collar for the upper inflatable packer 62 is operated to inflate the upper inflatable packer. Thereafter the valve in the cementing collar 64 in the string of pipe operates to build up the pressure on the cement slurry between the packers. Thus, in the operation of the system, a cement slurry is isolated by the packers and supplementally pressured through the collar 64 to maintain hydrostatic pressure in the annulus above the pore pressure of the formations.

Figure 4:
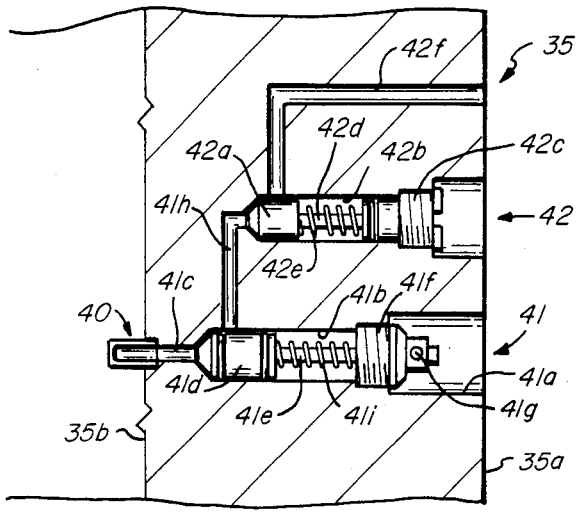
FIG. 4 is a schematic illustration of a partial view of a cementing collar embodying the present invention.

Referring now to FIG. 4, the operative portion of a cementing collar 35 is illustrated where the exterior circumferential surface of the collar 35 is indicated by the designation 35*a* and the surface of the bore of the collar 35 is designated 35*b*. The shear valve 41 typically includes a pocket or recess which extends between the surfaces 35*a*, 35*b*. The pocket or recess includes stepped cylindrical bores 41*a*, 41*b* and 41*c*. The bore 41*c* to the surface 35*b* is closed by a frangible break-off plug 40. The bore 41*b* receives a slidable valve element 41*d* with appropriate seal means and a cylindrical stem member 41*e* which slides through an opening in a cap member 41*f*. The cap member 41*f* is threadedly received in the end of the bore 41*b* and a shear pin 41*g* releasably interconnects the stem member 41*e* to the cap member 41*f* so that the valve member normally seals off or blocks flow of fluid between the bore 41*c* and a flow passage 41*b*. Pressure external to the collar 35 is admitted to one side of the piston member 41*d* through the cap member 41*f*. A spring member 41*i* also resiliently biases the piston member toward a closed position.

The check valve 42 typically includes a pocket which extends between the surface 35*a* and the flow passage 41*h*. A slidable valve element 42*a* in bore 42*b* normally closes the flow passage 41*h* and prevents fluid flow. A threaded cap member 42*c* is received in the bore 42*b* and has a hollow interior to slidably receive a valve stem 42*d* on the valve element 42*a*. A spring member 42*e* normally biases the valve element 42*a* to a closed position so that flow cannot occur between the flow passage 41*h* and a flow passage 42*f* until sufficient pressure is applied to the element 42*a*. The flow passage 42*f* extends between the bore 42*b* and the outer surface 35*a*.

In operation of the cementing collar, the knockout plug 40 is first removed by a wiper plug or other tool passed through the string of pipe. The valve 41 will not operate until the force on the valve element 41*d* produced by pressure in the bore of the collar exceeds the counteracting force on the valve element produced by pressure exterior to the valve collar, the force of the spring member 41*i* and the shear force of the shear pin 41*g*. Once the shear pin 41*g* is sheared, then the valve 41 can be opened and pressure applied to the valve 42 to open the valve 42 so that fluid flow can occur from the bore of the collar 35 to the exterior of the collar. Whenever the combined force produced by the pressure exterior of the collar and the spring member on a valve element exceeds the force produced by the pressure in the bore of the collar, the valves will close preventing back flow of fluid.

Figure 5:
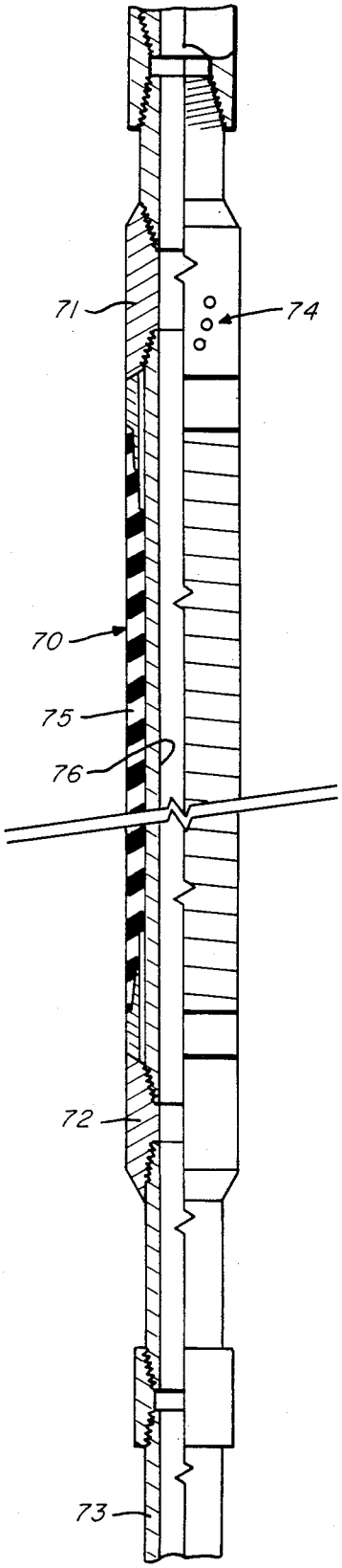
FIG. 5 is a schematic illustration of an inflatable well packer.

Referring now to FIG. 5, an inflatable packer 70 is schematically illustrated with a connection with a string of pipe in which an upper valve collar 71 is connected to one joint of a string of pipe and a lower valve collar 72 is connected to a lower string of pipe 73. The valve collar 72 has a valve system 74 which is arranged to selectively admit fluid from the interior of the pipe to an annular space in the valve collar. Between the valve collars 71 and 72 is an elastomer inflatable packer element 75 which is supported by a tubular support member 76. Upon the admission of fluid through the valving system 74, the packer element 75 inflates to contact the wall of a wellbore.

Figure 6:
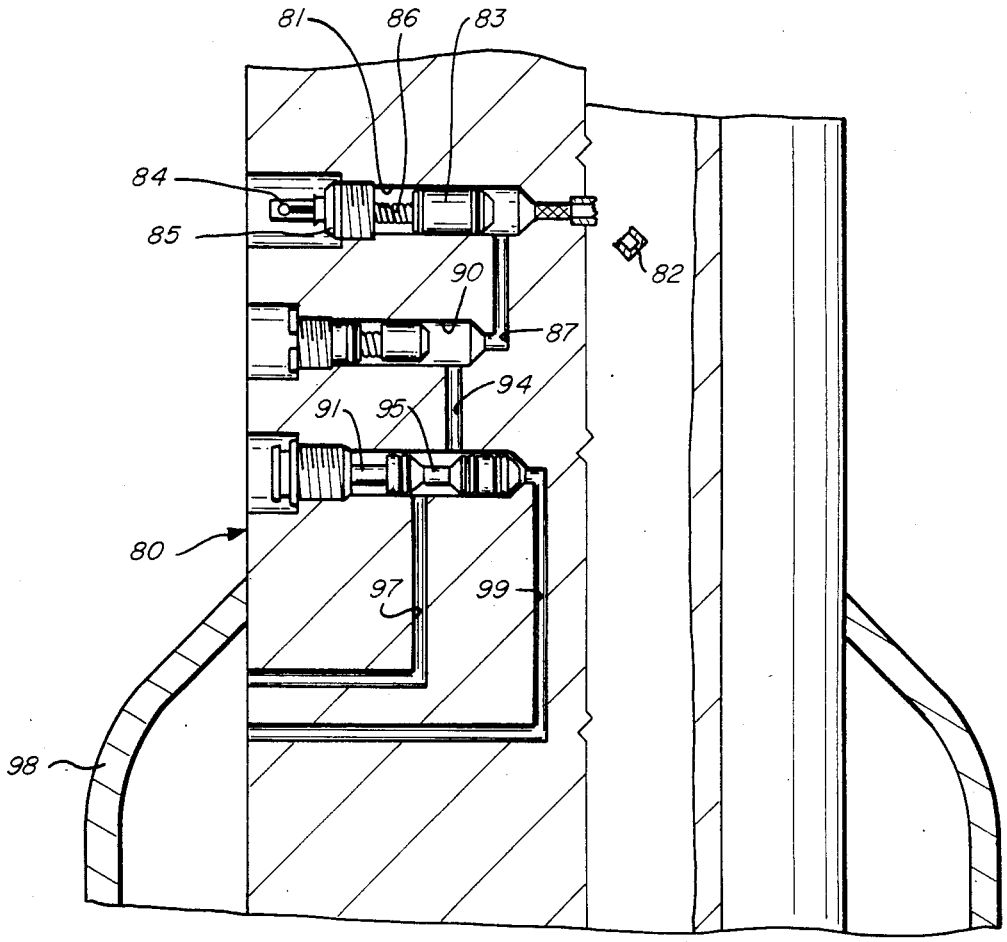
FIG. 6 is a partial view of a valve collar of an inflatable packer.

Referring now to FIG. 6, a typical valving arrangement for a valve collar 80 in an inflatable packer is illustrated. A first valve pocket 81 extends transversely through the wall of the valve collar, the valve pocket having an opening to the interior of the pipe and an opening to the exterior of the valve collar. The interior opening is normally closed with the break-off plug 82 which can be sheared or removed by a wiper plug or a bar. The interior opening is closed by a valve member 83 which normally engages a valve seat and is held in position by a shear pin interconnection 84 with a cap member 85. The valve member 83 is shown in an open position but would normally be in a closed position in the valve pocket until such time as the pressure in the interior of the pipe exceeds the pressure on the exterior of the pipe by a predetermined value of the shear pin whereupon the valve member 83 is moved to an open position and compresses a spring member 86. The valve pocket 81 is connected by a passage 87 to a check valve which is disposed in an intermediate pocket 90, the check valve having a valve member 91 for seating engagement with a valve seat and which is resiliently biased toward a closed position. When pressure within the passage 87 exceeds the hydrostaric pressure across the check valve the force opens the check valve to admit fluid to a conduit 94 which extends to a limit valve. The limit valve includes a valve member 95 disposed in a valve pocket where fluid in the conduit 94 may be passed through the valve to another conduit 97 to the interior of an inflatable packer element 98. When the pressure in the inflatable packer element 98 reaches a predetermined value, pressure through another conduit 99 moves the limit valve to a closed position where it is locked in a closed position to hold the packer element inflated and prevent further flow of fluid into or out of the packer element 98.

Figure 7:
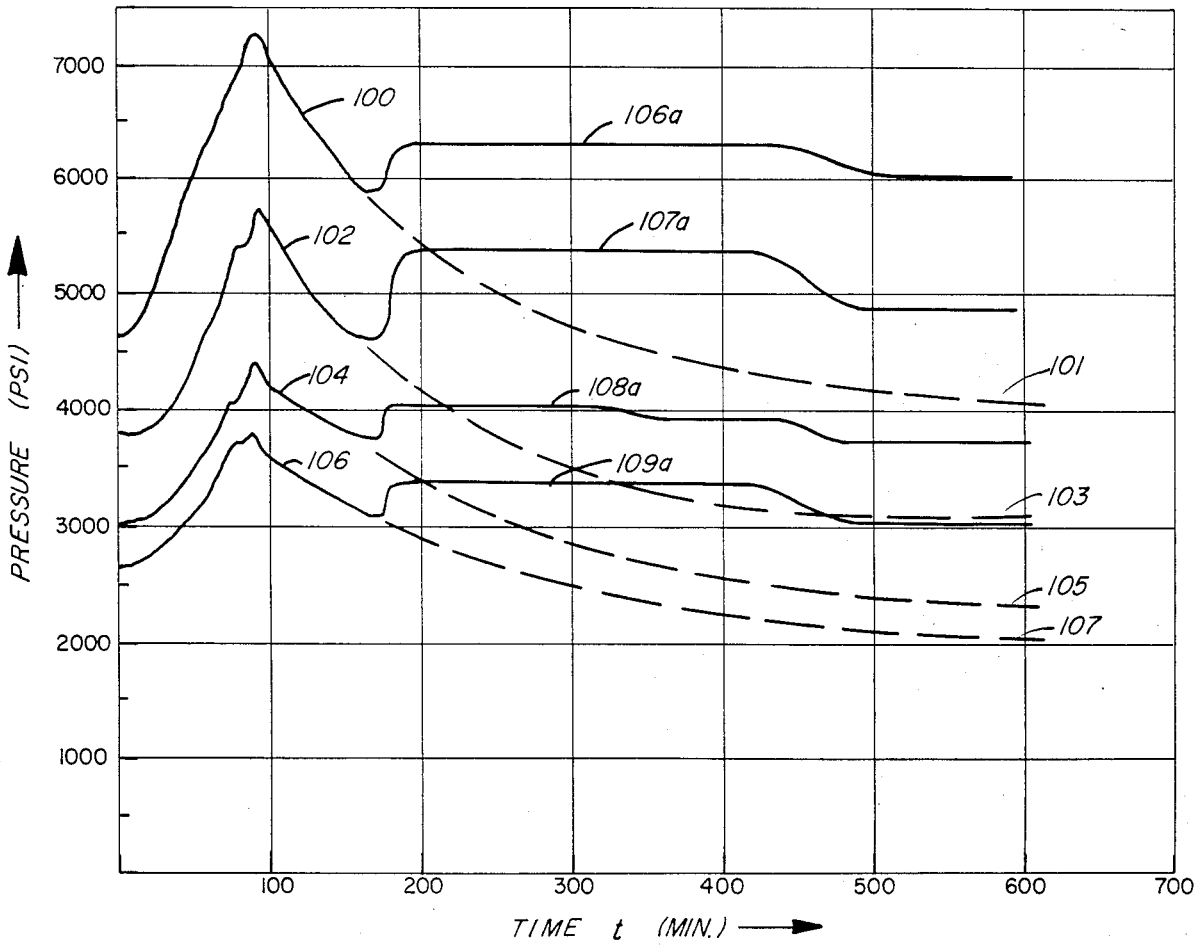
FIG. 7 is a graph that illustrates pressure in a cement slurry as a function of time for different depths.

Referring to FIG. 7, a graph illustrates pressure in a cement slurry as a function of time for different depths. Curve 100 represents a depth of approximately 8750 feet; curve 102 represents a depth of approximately 6900 feet; curve 104 represents a depth of approximately 5490 feet and curve 106 represents a depth of approximately 4780 feet. With the cement slurry introduced into the pipe at a time t=0, the pressure curves 100, 102, 104 and 106 show pressure in the annulus due to drilling mud. The curves 100, 102, 104 and 106 show a build up of pressure until the top cementing plug reaches the bottom of the pipe in approximately 98 minutes. Thereafter, the hydrostatic pressure would normally decrease to points 101, 103, 105 and 107.

If the pore pressure in the formations at 8750 is at 6000 psi it can be seen that this pressure exceeds the cement pressure and can affect the integrity of the cement before it fully hardens or sets. In the present invention the hydrostatic pressure is illustrated as increased at 8750 feet by admitting cement under pressure sufficient to raise the pressure level to say 6250 psi as shown by the line 106*a*. The pressure on the cement is maintained until the cement gels or obtains its initial set. Similarly, curves 107*a*, 108*a* and 109*a* illustrate increasing the cement pressure in the annulus by admitting cement under pressure from the interior of the pipe at various depths where the pore pressure is expected to exceed the pressure in the cement during the curing of the cement.

The foregoing disclosure and description of the invention are illustrative and explanatory thereof, and various changes in the size, shape and materials, as well as in the details of the illustrated construction may be made without departing from the spirit of the invention.

I claim:

1. A method for cementing a string of pipe in a borehole traversing earth formations comprising the steps of:

positioning a string of pipe in a borehole where the string of pipe has a plurality of selectively operable pressure responsive communication passages between the interior of the string of pipe and the exterior of the string of pipe in spaced apart locations along the length of the string of pipe so that the communication passages are proximate to earth formations having fluid or gas under pore pressure;

injecting a cement slurry from the earth's surface under pumping pressure through the interior of the string of pipe to move the cement slurry up into the annulus between the string of pipe and the borehole to a desired level in the annulus between the string of pipe and the borehole while maintaining the level of cement slurry in the interior of the string of pipe above the said one location;

discontinuing the pumping pressure when the cement slurry reaches the desired level on the annulus; and thereafter, opening the communication passages in sequence and providing cement slurry under pressure through the communication passages sufficient to maintain hydrostatic pressure on the cement slurry in the annulus at the location of a communication passage at a pressure higher than pore pressure until the cement has cured for preventing fluid or gas migration in the annulus.

2. The method as set forth in claim 1 wherein the passages are opened in an upward direction sequence beginning from the lowermost end of the string of pipe.

3. A method for cementing a string of pipe in a borehole traversing earth formations comprising the steps of:

positioning a string of pipe in a borehole where the string of pipe has a communication passage between the interior of the string of pipe and the exterior of the string of pipe in at least one location intermediate of the length of the spring of pipe so that the communication passage is proximate to earth formations having fluid or gas under pore pressure and where the string of pipe has an inflatable packet located above the communication passage;

injecting a cement slurry from the earth's surface under pumping pressure through the interior of the string of pipe to move the cement slurry up into the annulus between the string of pipe and the borehole to a desired level in the annulus between the string of pipe and the borehole while maintaining the level of cement slurry in the interior of the string of pipe above the said one location;

discontinuing the pumping pressure when the cement slurry reaches the desired level on the annulus; and inflating the inflatable packer into contact with the well bore and providing cement slurry under pressure through the communication passage sufficient to maintain hydrostatic pressure on the cement slurry in the annulus at said one location at a pressure higher than pore pressure until the cement has cured for preventing fluid or gas migration in the annulus.

4. The method as set forth in claim 3 wherein the communication passage is opened in response to pressure in the interior of the pipe and the inflatable packer is inflated by cement slurry prior to opening the communication passage.

5. The method as set forth in claim 3 wherein the string of pipe has a second inflatable packer located below the communication passage.

6. The method as set forth in claim 5 wherein the communication passage is opened in response to pressure in the interior of the pipe and the inflatable packers are inflated into contact with a wellbore prior to the cement slurry hardening.

* * * * *